US006086033A

United States Patent [19]

Calleja

[11] Patent Number: 6,086,033

[45] Date of Patent: Jul. 11, 2000

[54] WAREHOUSE DISPLAYER PANEL SYSTEM AND HINGE

[76] Inventor: Michael J. Calleja, 110 San Benito Rd., Brisbane, Calif. 94005

[21] Appl. No.: 09/238,396

[22] Filed: Jan. 27, 1999

[51] Int. Cl.[7] ..... A47G 29/02; E04G 3/08; E06B 7/28; G09F 15/00; E05F 1/02

[52] U.S. Cl. ..... 248/240; 40/606; 16/309

[58] Field of Search ..... 248/240, 243, 248/236, 237, 238; 16/309; 40/606, 642.02, 661.01

[56] References Cited

U.S. PATENT DOCUMENTS

Re. 26,190 4/1967 McDonnell ..... 248/240
790,793 5/1905 Koch ..... 248/240
5,624,045 4/1997 Highsmith et al. ..... 211/192
5,848,502 12/1998 Schaefer ..... 40/606

*Primary Examiner*—Ramon O. Ramirez
*Assistant Examiner*—Jerome A. DeLuca
*Attorney, Agent, or Firm*—Robert Charles Hill

[57] ABSTRACT

A displayer panel system comprises a universal hinge that can be used for top, middle, and bottom, and either left and right. The hinge has a parallelogramatical post that sticks out and bears the weight of a frame on a plastic wedge shaped disk attached to the frame bosses. A set of pins through the bosses, the plastic wedges, and the posts allow the frame to swing left and right out from a storage rack column. A double-pronged hook allows left or right corner face attachment of the hinge to slots in the storage rack column.

12 Claims, 3 Drawing Sheets

WAREHOUSE DISPLAYER PANEL SYSTEM AND HINGE

BACKGROUND OF THE INVENTION

1. Field of the Invention

The present invention relates to hinges, and more particularly to hinges that are used to merchandise door and window products on swinging displayers that hang from warehouse storage racks.

2. Description of Related Art

Retail warehouse sales operations like Home Depot, Home Base, Lumberjack, etc., have become very popular and successful. Such warehouse stores typically sell doors and windows where the inventory is stacked in storage racks. Sometimes the stores will display samples on swinging panels that allow shoppers to look at both sides of the unit and then to fold it back out of the way of the aisle. A typical such storage rack is described by Charles E. Highsmith, et al., in U.S. Pat. No. 5,624,045, issued Apr. 29, 1997. Latched beam-to-column connectors are used to create a storage rack that is strong and easy to erect.

Prior art hinges attach to such racks to create half-height and full-height displayer panels. These hinges attach to either of the two outside corners of the rack columns. Two types are therefore needed, one for the left-corner and one for the right-corner of the column. Prior art displayer panels ordinarily require two extra hinges and a special full-length panel to extend from a half-height to a full-height displayer panel.

SUMMARY OF THE INVENTION

An object of the present invention is to provide a single hinge for a displayer panel that can be used on either the left or right corner of storage-rack columns.

Another object of the present invention is to provide a displayer panel system that is simple and easy to use and extends from a half-height to a full-height displayer panel.

Briefly, a displayer panel system embodiment of the present invention comprises a universal hinge that can be used for top, middle, and bottom, and either left or right. The hinge has a parallelogramatical post that sticks out and bears the weight of a frame on a plastic wedge shaped disk attached to the frame bosses. A set of pins through the bosses, the plastic wedges, and the posts allow the frame to swing left and right out from a storage rack column. A double-pronged hook allows left or right corner face attachment of the hinge to slots in the storage rack column.

An advantage of the present invention is that a hinge is provided that is universal and can be used for top, middle, and bottom, and either left and right on a warehouse storage rack displayer system.

Another advantage of the present invention is that a warehouse storage rack displayer system is provided that is simple and easy to extend on site from a half-height system to a full-height system and with the addition of only one more hinge.

The above and still further objects, features, and advantages of the present invention will become apparent upon consideration of the following detailed description of specific embodiments thereof, especially when taken in conjunction with the accompanying drawings.

DETAILED DESCRIPTION OF THE INVENTION

Figure 1:
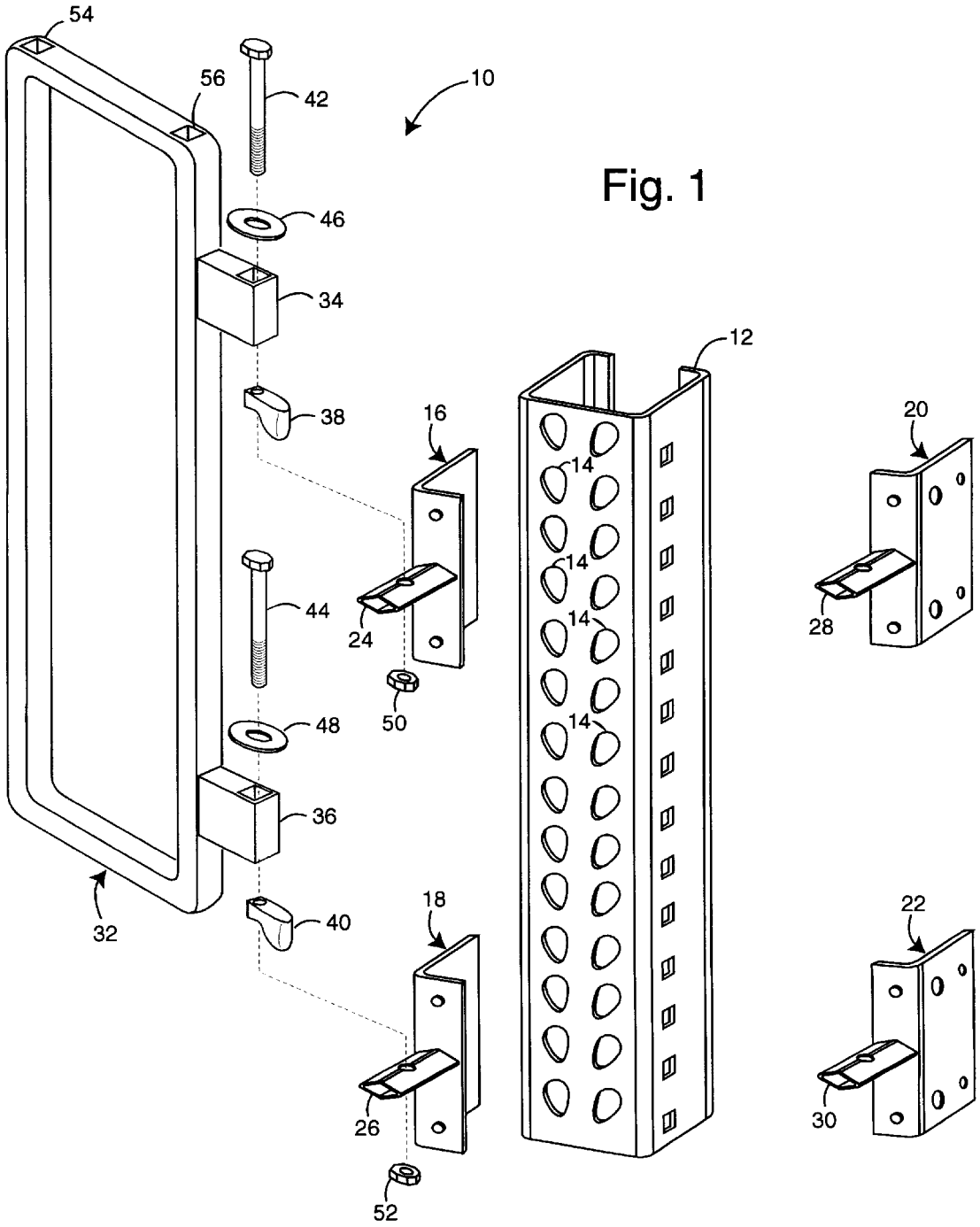
FIG. 1 is an exploded assembly diagram of a first displayer panel system embodiment of the present invention with a single half-height swinging frame.

FIG. 1 illustrates a displayer panel system embodiment of the present invention, referred to herein by the reference numeral 10. The displayer panel system 10 attaches to a standard warehouse storage rack column 12 on either a left or right corner face. The column 12 includes a series of slots 14 that allow various attachments to be hooked on. Matching hooks in such attachments drop down into narrowed portions of the slots 14 to create a firm locking grip.

A pair of left-corner face hinges 16 and 18, or a pair of right-corner face hinges 20 and 22 can be used. Both left and right can be used to accommodate two different displayer panel systems 10 being attached to the same column 12. In such case, one would be swung left and the other swung right.

It is critical to the present invention that only one type of hinge is needed for any of hinges 16, 18, 20, and 22. It should be obvious from FIG. 1 that hinges 16 and 18 are identical, and that hinges 20 and 22 are also the same as hinges 16 and 18 only flipped-over top-for-bottom. The hinges 16, 18, 20, and 22 use double pronged hooks to lock on and grip the column 12 in either position represented in FIG. 1.

Each of hinges 16, 18, 20, and 22, have a parallelogramatical cross-section post 24, 26, 28, and 30, respectively. It is critical to the present invention that these parallelogramatical cross-section posts 24, 26, 28, and 30 have symmetrical top and bottom sections. This is so they present the same triangular rise when used in the situations of hinges 16 and 18 or the situations of hinges 20 and 22.

A swinging frame 32 has a pair of bosses 34 and 36 and plastic wedges 38 and 40. A bottom face of each plastic wedge transfers the weight of the swinging frame 32 to the top face of corresponding parallelogramatical cross-section posts 24, 26, 28, and 30. Such interface is meant to swivel around on a pair of bolts 42 and 44, and will naturally assume only one of two stable positions. A first stable position is shown in FIG. 1, the swinging frame 32 has folded itself left perpendicular to the parallelogramatical cross-section posts 24, 26, 28, and 30. The second stable position will be where the swinging frame 32 has folded itself right and is again perpendicular to the parallelogramatical cross-section posts 24, 26, 28, and 30. In order for the swinging frame 32 to stay straight out, someone or something will have to hold it there. This is intended to be suitable for a warehouse merchandising display where the product should automatically fold itself back away from the aisle.

The bolts 42 and 44 are also equipped with a pair of washers 46 and 48 and a pair of aircraft-type nuts 50 and 52. The nuts 50 and 52 are only threaded down on the bolts 42 and 44 enough to kept the frame 32 from coming loose.

A pair of holes 54 and 56 are provided for extension swinging frames, or such may be sealed off with plastic plugs.

Figure 2:
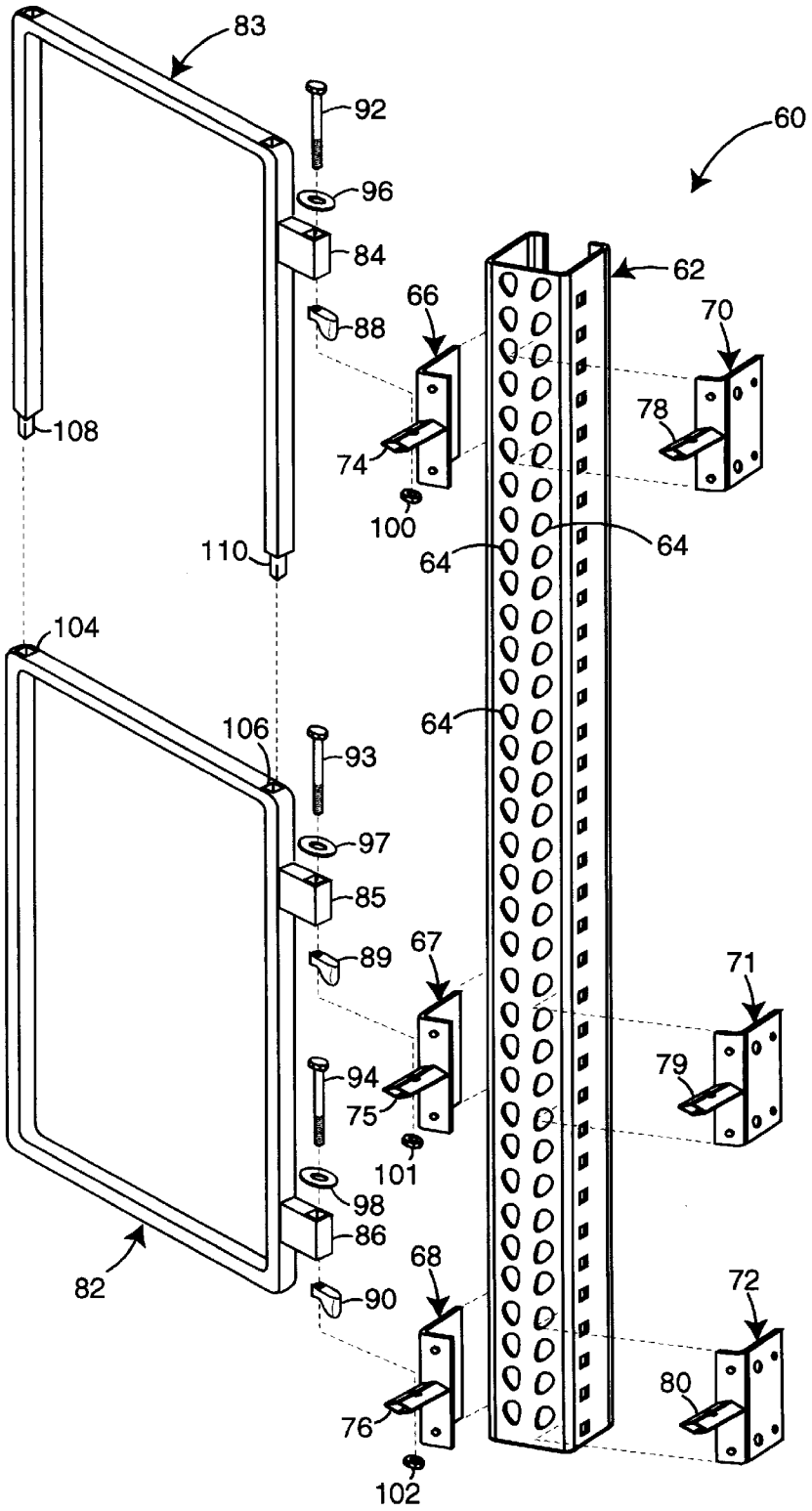
FIG. 2 is an exploded assembly diagram of a second displayer panel system embodiment of the present invention with a single half-height swinging frame and an extension frame that converts its use to full-height.

FIG. 2 shows an extended-frame displayer panel system embodiment of the present invention, referred to herein by the reference numeral 60. The basic half-height portion can be system 10 shown in FIG. 1. The displayer panel system 60 attaches to a standard warehouse storage rack column 62 on either its left or right corner face. The column 62 includes a series of slots 64 that allow various attachments to be hooked on. Matching hooks in such attachments drop down into narrowed portions of the slots 64 to create a firm locking grip.

A set of three left-corner face hinges 66–68, or a set of three or right-corner face hinges 70–72 can be used. This represents an increase of only one hinge over that shown for system 10 in FIG. 1. It is critical to the present invention that only one type of hinge be used for any of hinges 66–72. It should be obvious from FIG. 2 that hinges 66–68 are identical, and that hinges 70–72 are also the same as hinges 66–68 only flipped-over top-for-bottom.

Each of hinges 66–72, have a parallelogramatical cross-section post 74–76 and 78–80, respectively. It is critical to the present invention that these parallelogramatical cross-section posts 74–76 and 78–80 have symmetrical top and bottom sections. This is so they present the same triangular rise when used in the situations of hinges 66–68 or the situations of hinges 70–72.

A swinging frame 82 and a frame extension 83 together have a set of three of bosses 84–86 and plastic wedges 88–90. A bottom face of each plastic wedge transfers the weight of the swinging frames 82 and 83 to the top face of corresponding parallelogramatical cross-section posts 74–76 and 78–80. Such interface is mechanically configured to swivel around on a set of three of bolts 92–94, and will naturally assume only one of two stable positions. A first stable position is shown in FIG. 2, the swinging frames 82 and 83 have folded themselves left and perpendicular to the parallelogramatical cross-section posts 74–76 and 78–80. The second stable position will be where the swinging frames 82 and 83 have folded themselves to the right and perpendicular to the parallelogramatical cross-section posts 74–76 and 78–80. In order for the swinging frames 82 and 83 to stay straight out, someone or something will have to hold it there. This is intended to be suitable for a warehouse merchandising display where the product should automatically fold itself back away from the aisle.

The bolts 92–94 are also equipped with a set of three of washers 96–98 and a set of three of aircraft-type nuts 100–102. The nuts 100–102 are only threaded down on the bolts 92–94 enough to kept the frames 82 and 83 from coming loose.

A pair of holes 104 and 106 are provided on frame 82 to receive a pair of matching connecting posts 108 and 110 on the extension frame 83. It is critical in embodiments of the present invention that the system 10 of FIG. 1 be upgradeable to the system 60 of FIG. 2 on site by the simple addition of frame 83 and its matching hinge hardware without necessitating any substantial disassembly of any other part of system 10.

Holes in the angled sides of the hinges 66–68 and 70–72 can be used to bolt them more firmly to the column 62. A flat faced hinge can also be used in which four or more double-pronged hooks are used to engage both rows of the slots 64 in a flat face-to-face attachment.

Figure 3:
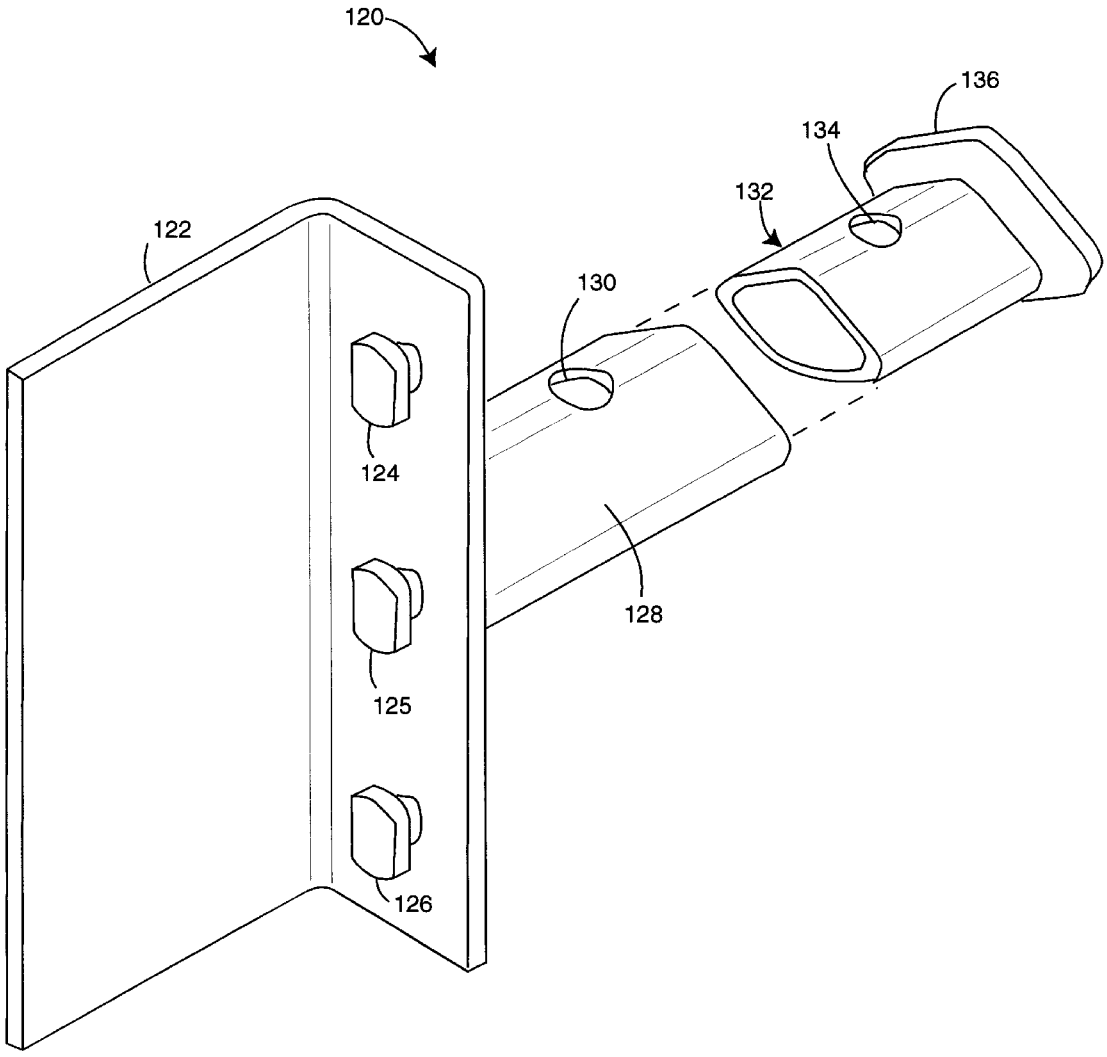
FIG. 3 is a perspective view diagram of a hinge embodiment of the present invention that includes a set of three double pronged hooks and that can receive a plastic advertising plug.

In FIG. 3, a hinge 120 is shown that is similar to those of FIGS. 1 and 2. The hinge 120 includes a base 122 of angle iron and a set of three double-pronged hooks 124–126. A parallelogramatical cross-section post 128 mounts perpendicular to the face opposite the three double-pronged hooks 124–126. A hole 130 allows the passing through of an axle pin such as bolts 92–94 in FIG. 2. A plastic advertising plug 132 also has a hole 134 for passing through the same axle pin. A cap 136 has a face on it that can be used to present the logo of a manufacturer or other advertising message. The double-pronged hooks 124–126 are intended to mate and lock with the slots in a standard storage rack column such as illustrated in FIGS. 1 and 2. The shape of the double-pronged hooks 124–126 allows the hinge 120 to lock in either up or down orientation when pressed down into the slots by the weight it bears. The preferred cross-section in the vertical plane of the double-pronged hooks 124–126 resembles a "T", and in the horizontal plane it resembles an "I".

Although particular embodiments of the present invention have been described and illustrated, such is not intended to limit the invention. Modifications and changes will no doubt become apparent to those skilled in the art, and it is intended that the invention only be limited by the scope of the appended claims.

What is claimed is:

1. A universal hinge for attaching displayer panels to warehouse storage racks, comprising:

a base that can be attached to a column of a storage rack;

a parallelogramatical cross-section post attached to the base and perpendicular to said column and having similar top and bottom triangular faces;

a hole provided through the middle of the post and providing for a vertically oriented axle pin; and a swinging wedge shaped cam through which said axle pin is disposed and that rides up and down said top face of the post such that an attached panel will be forced to fold to one side.

2. The hinge of claim 1, further comprising:

a set of double-pronged hooks on a backside of the base that allow the base to be hooked onto a series of slots provided along a front face said column, and have a cross-section in the vertical plane that resembles a "T", and in the horizontal plane that resembles an "I".

3. The hinge of claim 2, wherein:

said column has a rectangular cross-section and has a series of slots provided along a front face said column; and the base has an angular cross-section and can be mounted to either a left front corner or a right front corner of said column.

4. The hinge of claim 2, wherein:

said column has a rectangular cross-section and has two vertical columns of slots provided along a front face said column; and the base has an angular cross-section and can be mounted to either a left front corner or a right front corner of said column and engages a single corresponding column of said slots.

5. The hinge of claim 4, wherein:

two such bases may be simultaneously mounted to said left front corner and right front corner of said column and each engages a corresponding left or right column of said slots.

6. A merchandising display system, comprising:

a swinging frame that provides a mount for panel-type products to be displayed in a warehouse store;

a pair of hinge bases that can be fixed to a column of a storage rack in said warehouse store;

a parallelogramatical cross-section post attached to each of the hinge bases and that is perpendicular to said column and having similar top and bottom triangular faces;

a hole provided through the middle of each of the posts and providing for a vertically oriented axle pin; and a pair of swinging wedge shaped cams attached to swinging frame and through which a corresponding said axle pin is disposed, and that rides up and down said top face of the post such that the swinging frame will be automatically forced to fold to one side.

7. The system of claim 6, further comprising:

a set of double-pronged hooks on a backside of the hinge bases that allow each hinge base to be hooked onto a series of slots provided along a front face said column, and that each have a cross-section in the vertical plane that resembles a "T", and in the horizontal plane that resembles an "I".

8. The system of claim 7, wherein:

said column has a rectangular cross-section and has a series of slots provided along a front face said column; and the hinge bases each have an angular cross-section and can be mounted to either a left front corner or a right front corner of said column.

9. The system of claim 7, wherein:

said column has a rectangular cross-section and has two vertical columns of slots provided along a front face said column; and the hinge bases each have an angular cross-section and can be mounted to either a left front corner or a right front corner of said column and engages a single corresponding column of said slots.

10. The system of claim 9, wherein:

two such sets of hinge bases may be simultaneously mounted to said left front corner and right front corner of said column and each engages a corresponding left or right column of said slots.

11. The system of claim 10, wherein:

said two sets of hinge bases each use hinge bases that are essentially identical to one another and that can be used on either the left or right side by simply being flipped over.

12. The system of claim 6, further comprising:

a frame extension that plugs into the top of the swinging frame; and a third hinge base that can be fixed to said column above two other hinge bases;

a third parallelogramatical cross-section post attached to the third hinge bases and that is perpendicular to said column and that has similar top and bottom triangular faces;

a hole provided through the middle of the third post and that provides for a third vertically oriented axle pin; and a third swinging wedge shaped cam attached to the frame extension and through which said corresponding third axle pin is disposed, and that rides up and down said top face of the post such that the swinging frame and the frame extension will be automatically forced to fold to one side;

wherein, four hinge bases are not required for a full-height panel display.

* * * * *